US005179880A

United States Patent [19]

Sherick

[11] Patent Number: 5,179,880

[45] Date of Patent: Jan. 19, 1993

[54] DEVICE FOR STACKING SHEETS OF PAPER

[75] Inventor: Michael T. Sherick, Thousand Oaks, Calif.

[73] Assignee: Japan Digital Laboratory Co., Ltd., Japan

[21] Appl. No.: 785,279

[22] Filed: Oct. 30, 1991

[51] Int. Cl.[5] ..... B65H 31/00

[52] U.S. Cl. ..... 83/83; 271/175; 271/213

[58] Field of Search ..... 83/83, 86; 271/175, 271/213

[56] References Cited

U.S. PATENT DOCUMENTS

| | | | |
|---|---|---|---|
| 3,312,133 | 4/1967 | Judelson | 83/83 |
| 3,371,631 | 3/1968 | Rockerath | 493/449 X |
| 3,438,625 | 4/1969 | Ramsey et al. | 271/175 |
| 3,500,780 | 3/1970 | Emus et al. | 83/83 X |
| 3,712,609 | 1/1973 | Robert | 271/175 |
| 3,788,175 | 1/1974 | Davis | 83/83 |
| 4,624,615 | 11/1986 | Russell et al. | 271/175 |
| 4,804,174 | 2/1989 | Terhorst | 271/207 |

*Primary Examiner*—Eugenia Jones
*Attorney, Agent, or Firm*—Poms, Smith, Lande & Rose

[57] ABSTRACT

A stacking device which may be used with plotters, printers, copiers, or other paper or material handling machines for stacking single sheets of paper or material exiting such machines, and cutting and stacking a plurality of sheets from continuous sheets of paper and material exiting such machines. A motor mounted on a paper or material handling machine is used to rotate a drive shaft causing two arms to rotate. A stacking rod is attached to the rotating arms. Sheets of paper or material exiting the machine are stacked on top of the stacking rod. The arms are initially rotated to an upward position so that a sheet exiting the machine is draped over the stacking rod. The motor then rotates the arms to a downward position where the sheet hangs vertically draped over the stacking rod. This procedure may be repeated for the purpose of stacking other sheets on the rod. Switches may be used to control movement of the arms. A cutter is used to cut individual sheets from a continuous sheet exiting the machine.

18 Claims, 2 Drawing Sheets

DEVICE FOR STACKING SHEETS OF PAPER

BACKGROUND OF THE INVENTION

The present invention relates generally to devices for cutting and stacking sheets of paper, and more particularly to a device which may be used for stacking single sheets of paper or material, and cutting and stacking continuous sheets of paper or material exiting from a plotter, printer, copier, or other machine.

In the past, various devices have been used in plotters, printers, copiers, or other paper or material handling machines for the purpose of stacking or cutting sheets of paper or material. For example, U.S. Pat. No. 4,804,174, issued to Horst on Feb. 14, 1989, discloses an apparatus for collecting sheets of paper of different lengths. The apparatus uses an S-shaped plate to stack paper sheets of different sizes. U.S. Pat. No. 3,312,133, issued to Judelson on Apr. 4, 1987, describes a sheet material cutting machine that uses blades 28 and 30 to cut sheet material into separate sheets which are stacked on a receiving arm. An apparatus for cutting and dispensing sheets of material from a roll of the material is shown in U.S. Pat. No. 3,788,175, issued to Davis on Jan. 29, 1974. Finally, U.S. Pat. No. 3,438,625, issued to Ramsey et al. on Apr. 16, 1969, describes a stacking mechanism used for stacking apparel articles.

None of the above devices can be used for the combined functions of stacking single sheets of paper or material, and cutting and stacking sheets from continuous sheets of paper or material. There is a need for an economical device that will provide such functions.

SUMMARY OF THE INVENTION

It is an object of this invention to provide a stacking device for use with plotters, printers, copiers, or other paper or material handling machines that may be used to stack single sheets of paper or material exiting such machines, and to cut and stack a plurality of sheets from continuous sheets of paper or material exiting such machines.

It is another object of this invention to provide a stacking device that will stack sheets of paper or material without folding or wrinkling the sheets.

It is still another object of this invention to provide a stacking device which stacks sheets of paper or material vertically in order to minimize the amount of space needed to stack the sheets.

It is still another object of the invention to provide a stacking device that is simple to use and economical to manufacture.

These and other objects and advantages are attained by a stacking device which may be used with plotters, printers, copiers, or other paper or material handling machines for stacking single sheets of paper or material exiting such machines, and cutting and stacking a plurality of sheets from continuous sheets of paper and material exiting such machines. A motor mounted on a paper or material handling machine is used to rotate a drive shaft causing two arms to rotate. A stacking rod is attached to the rotating arms. Sheets of paper or material exiting the machine are stacked on top of the stacking rod. The arms are initially rotated to an upward position so that a sheet exiting the machine is draped over the stacking rod. This motor then rotates the arms to a downward position where the sheet hangs vertically draped over the stacking rod. This procedure may be repeated for the purpose of stacking other sheets on the rod. Switches may be used to control movement of the arms. A cutter is used to cut individual sheets from a continuous sheet exiting the machine.

In accordance with a broader aspect of the invention, a stacking rod is movably mounted below the path of sheets exiting a paper or material handling machine, and is selectively raised to engage the sheets, so that successive sheets are draped over the rod. A braking member may be used to limit the upward movement of the stacking rod and to prevent the sheets from further movement over the rod when the rod is moved upward during a stacking cycle.

The various features of the present invention will be best understood together with further objects and advantages by reference to the following description of the preferred embodiment taken in conjunction with the accompanying drawings.

DESCRIPTION OF THE PREFERRED EMBODIMENT

The following specification taken in conjunction with the drawings sets forth the preferred embodiment of the present invention in such a manner that any person skilled in the art can make or use the invention. The embodiment of the invention disclosed herein is the best mode contemplated by the inventor for carrying out his invention in a commercial environment although it should be understood that various modifications can be accomplished within the parameters of the present invention.

Figure 1:
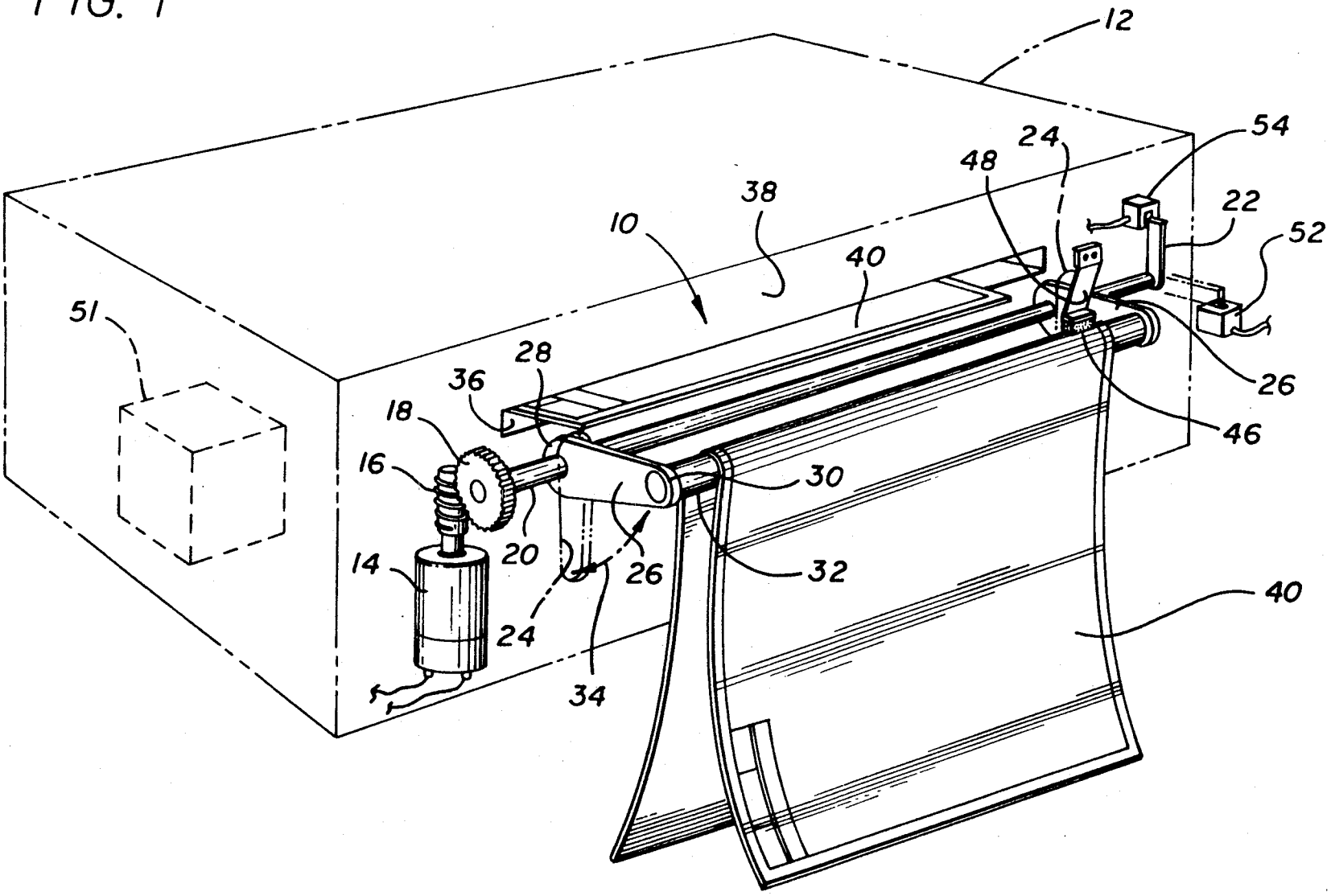
FIG. 1 is a perspective view of a stacking device mounted on a paper handling machine represented by dashed lines, illustrating the principles of the present invention, showing a sheet of paper stacked on a stacking rod fastened to and between ends of two rotatable arms with the rod disposed in an upward position.

FIG. 1 shows a stacking device 10 of the present invention mounted on a paper handling machine 12. The paper handling machine 12 may be a plotter, printer, copier, or the like. Also, machine 12 may be a material handling machine such as a machine for sorting and/or cutting fabric, or the like. It is the intent of the application that the stacking device 10 may be used with any machine that is used for cutting and/or stacking sheets of paper or material.

Parts of the stacking device 10 may be mounted inside the machine 12 as shown in FIG. 1. However, the entire device 10 may be mounted either inside or outside the machine 12, if desired. Referring to the embodiment shown in FIG. 1, the stacking device 10 has a motor 14 with a gear 16 thereon mounted inside the machine 12. Gear 16 engages a gear 18 attached to one end of a drive shaft 20. Shaft 20 is rotatably mounted inside the machine 12. A control member 22 is attached to the other end of the shaft 20.

The machine 12 has two apertures 24 therein. Rotating arms 26 attached to the drive shaft 20 fit through the apertures 24 from inside the machine 12 as shown in FIG. 1. Note that the ends 28 of the arms 26 inside the machine 12 are attached to shaft 20. The outer ends 30 of the rotating arms 26 are attached to a stacking rod 32 located outside the machine 12.

Figure 2:
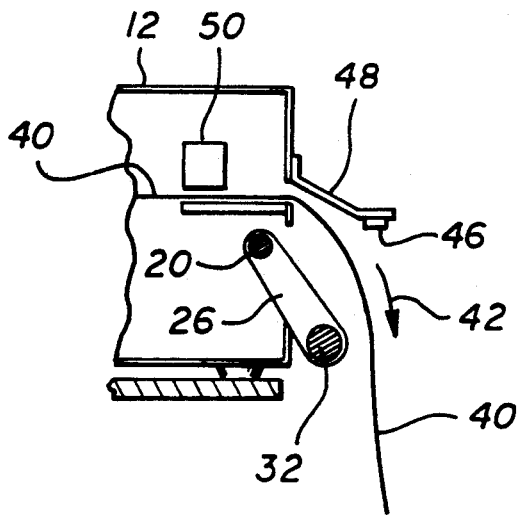
FIG. 2 is a partial cross-sectional view of the stacking device and paper handling machine of FIG. 1 showing a continuous sheet of paper being transmitted out an exit port in the machine while the rotatable arms and stacking rod are disposed in a downward position.
Figure 5:
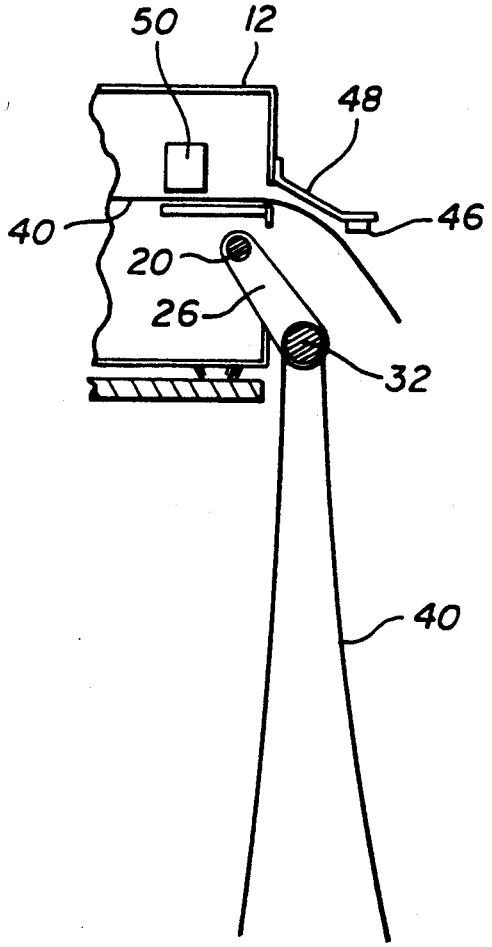
FIG. 5 is a view taken like FIG. 2 showing the rotatable arms and stacking rod in the downward position with the cut sheet of paper stacked on the rod.

Motor 14 may be used to rotate drive shaft 20 using engaged gears 16 and 18 so that the rotating arms 26 may be rotated to an upward position as shown in FIG. 1 and indicated by arrow 34. As illustrated in FIGS. 2 and 5, motor 14 may also rotate arms 26 to a downward position.

Figure 3:
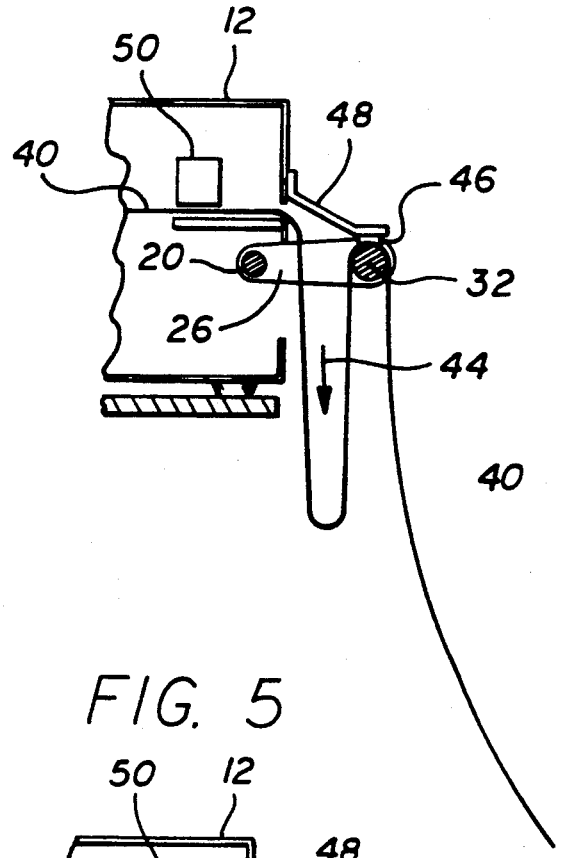
FIG. 3 is a view taken like FIG. 2 showing the continuous sheet of paper still exiting through the exit port and the rotatable arms and stacking rod in the upward position with the rod pressing the sheet of paper against a contact portion of a stopper.

Referring again to FIG. 1, the machine 12 has an exit port 36 in a front wall 38 thereof. Sheets 40 of paper or material exit the machine 12 through exit port 36. The sheets 40 may be single sheets or sheets cut from a continuous sheet of paper or material. FIG. 2 shows continuous sheet 40 passing through exit port 36. As illustrated, the sheet 40 moves downward as indicated by arrow 42. Motor 14 has been activated to rotate the arms 26 to a downward position. After sheet 40 has exited the machine, a control system 51 such as a microprocessor, computer, or any electrical control means activates motor 14 to rotate arms 26 to an upward position as shown in FIG. 3 so that sheet 40 is draped over stacking rod 32 while continuous sheet 40 continues in a downward direction as indicated by arrow 44.

The upward rotation of arms 26 to the upward position causes stacking rod 32 to press sheet 40 against a contact portion 46 of a stopper 48 attached to front wall 38 of the machine 12. Contact portion 46 is preferably located at a height adjacent the height of exit port 36. However, the height of contact portion 46 may be varied as desired.

Figure 4:
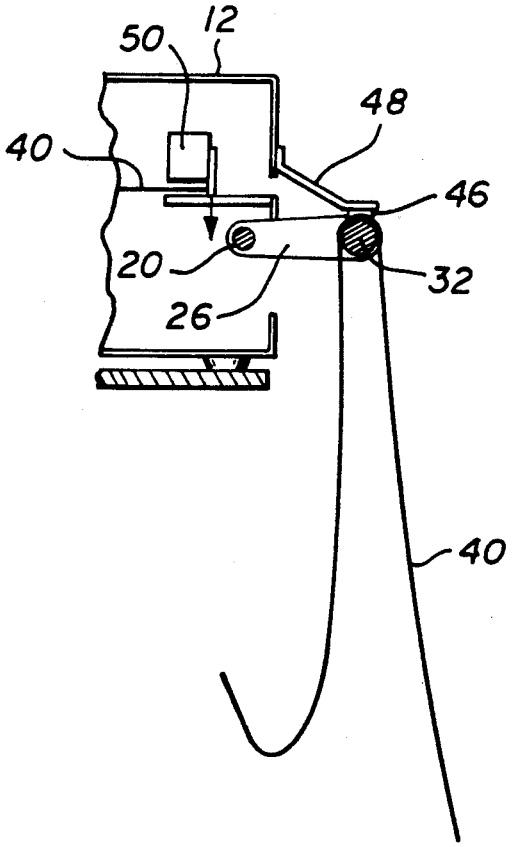
FIG. 4 is a view taken like FIG. 2 showing the continuous sheet of paper falling downward after a cutter has cut the sheet to a desired size with the rotatable arms and stacking rod still in the upward position.

After arms 26 reach the upward position, the control system 51 activates a cutter 50 which cuts sheet 40 to a desired length, and sheet 40 then falls downward as shown in FIG. 4. The arms 26 are then rotated downward by the control system 51 as shown in FIG. 5 with the desired length of sheet 40 being stacked on stacking rod 32. This procedure is repeated until the desired number of sheets 40 are stacked vertically on rod 32. Note that stacked sheets 40 will hang vertically downward on stacking rod 32, eliminating the need for extra horizontal space typically needed to stack sheets in horizontal or included holding trays.

Limit switches 52 and 54 (see FIG. 1) may be mounted on the machine 12 and used to control the downward and upward movement, respectively, of the rotating arms 26. As the arms 26 rotate downward and upward control member 22 attached to drive shaft 20 comes into contact with switches 52 and 54 which activate motor 14 causing it to rotate the arms 26 downward or upward, as desired. Such downward or upward movement may be delayed or timed, as desired, to coordinate movement with cutter 50. The switches 52 and 54 may be used as part of the control system 51, if desired. As such, switch 54 and stopper 48 may be used to control the upward movement of the rotating arms 26, and switch 52 may be used to control the downward movement of the arms 26.

The procedure described above may also be used to stack single (pre-cut) sheets 40 on stacking rod 32. Sensors (not shown) may be used to determine when the end of each sheet 40 to be stacked has passed through exit port 36 in order to activate motor 14 for the purpose of rotating arms 26 to the downward position. Sensors may also be used to sense or detect that another sheet 40 is passing through port 36 and to activate motor 14 causing arms to rotate upward to the upward position as described above. The control system 51 may also be programmed to provide the same results. The sensors may be used as part of the control system 51, if desired.

The above description discloses the preferred embodiment of the present invention. However, persons of ordinary skill in the art are capable of numerous modifications once taught these principles. For example, only one or any number of rotating arms 26 may be used. Gear 18 may be attached to the middle of drive shaft 20 or at any other position along the shaft, and the motor 14 may be mounted at any location inside or outside the machine 12 for the purpose of engaging gear 18. Also, the stacking rod may be moved upward and downward by pistons, electromagnets, or any suitable means. Accordingly, it will be understood by those skilled in the art that changes in form and details may be made to the above-described embodiment without departing from the spirit and scope of the invention.

I claim:

1. A stacking device for stacking sheets of paper or material exiting, during successive cycles of operation, from a printer, plotter, copier, or other paper or material handling machine, comprising:

a stacking rod movably mounted at an output from said handling machine, said stacking rod being located below a path of said sheets out of said machine;

means for shifting the position of said stacking rod to upward and downward positions during each cycle of operation so that (1) said stacking rod comes into contact with one of said sheets exiting said machine when said stacking rod is in said upward position during said each cycle of operation causing said one sheet to drape over said stacking rod, so that (2) said sheet hangs vertically and downwardly draped over said stacking rod when said stacking rod is in said downward position during said each cycle of operation, and so that (3) a plurality of said sheets are stacked on top of said stacking rod and on top of each other during successive cycles of operation, said means for shifting the position of said stacking rod including:

(a) a drive shaft rotatably mounted on said machine, (b) at least one arm, each of said arms having one end thereof attached to said drive shaft and the other end thereof attached to said stacking rod, and (c) a motor mounted on said machine and engaged to said drive shaft; and means for controlling upward and downward rotation of said stacking rod and for controlling rotation of said drive shaft.

2. The stacking device of claim 1 further comprising braking means for limiting upward rotation of said stacking rod and holding said sheets against further movement over said stacking rod when said stacking rod is moved upward.

3. The stacking device of claim 2 wherein said braking means comprises a stopper attached to said machine having a contact portion adapted so that said stacking rod presses each of said sheets against said contact portion.

4. The stacking device of claim 3 wherein said means for controlling upward and downward rotation of said stacking rod and for controlling rotation of said drive shaft comprises a control member attached to said drive shaft and switches mounted on said machine.

5. The stacking device of claim 4 wherein said arms fit through apertures in said machine.

6. The stacking device of claim 3 wherein said means for shifting the position of said stacking rod further includes a gear attached to said shaft, and a gear attached to said motor engaging said gear attached to said shaft.

7. The stacking device of claim 1 further comprising means for cutting a continuous sheet exiting said machine into a plurality of said sheets.

8. The stacking device of claim 7 wherein said means for cutting is located inside said machine.

9. A stacking device for stacking sheets of paper or material exiting from a printer, plotter, copier, or other paper or material handling machine, comprising:

a drive shaft rotatably mounted on said machine;

at least one arm, each of said arms having one end thereof attached to said drive shaft;

a stacking rod attached to the other end of each of said arms;

means for rotating each of said arms to upward and downward positions during cycle of rotation so that (1) said stacking rod comes into contact with one of said sheets exiting said machine when said arms are in said upward position during said each cycle of rotation, causing said one sheet to drape over said stacking rod, so that (2) said sheet hangs vertically and downwardly draped over said stacking rod when said arms are in said downward position during said each cycle of rotation, and so that (3) a plurality of said sheets are stacked on top of said stacking rod and on top of each other during successive cycles of rotation, said means for rotating including a motor mounted on said machine and engaged to said drive shaft; and means for controlling activation of said means for rotating each of said arms to upward and downward positions in order to control upward and downward rotation of said stacking rod and to control rotation of said drive shaft.

10. The stacking device of claim 9 wherein said means for controlling activation comprises switches mounted on said machine.

11. The stacking device of claim 10 further comprising means for limiting upward rotation of each of said arms.

12. The stacking device of claim 11 wherein said means for limiting upward rotation comprises a stopper attached to said machine having a contact portion adapted so that said stacking rod presses each of said sheets against said contact portion.

13. The stacking device of claim 12 wherein said means for controlling activation further comprises a control member attached to said drive shaft adapted to contact said switches during rotation of said arms to said upward and downward positions.

14. The stacking device of claim 9 further comprising means for cutting a continuous sheet exiting said machine into a plurality of said sheets.

15. The stacking device of claim 9 wherein said means for rotating said arms to upward and downward positions comprises a gear attached to said drive shaft and a gear attached to said motor engaging said gear attached to said shaft.

16. A stacking device for stacking sheets of paper or material exiting from a printer, plotter, copier, or other paper or material handling machine, comprising:

a drive shaft rotatably mounted on said machine;

at least one arm, each of said arms having one end thereof attached to said drive shaft;

a stacking rod attached to the other end of each of said arms;

a motor mounted on said machine;

gear means for engaging said motor to said drive shaft; and means for controlling activation of said motor and for controlling each cycle of rotation of said arms by said motor in order to control upward and downward rotation of said stacking rod and to control rotation of said drive shaft so that (1) said arms rotate to an upward position during said each cycle of rotation where one of said sheets exiting from said machine is draped over said stacking rod, and so that (2) said arms rotate to a downward position during said each cycle where said one sheet hangs vertically stacked on top of said stacking rod and on top of each of said sheets stacked on said stacking rod during previous cycles of rotation of said arms.

17. The stacking device of claim 16 further comprising means for cutting a continuous sheet exiting said machine into a plurality of said sheets.

18. The stacking device of claim 17 wherein said means for controlling comprises a control member attached to said drive shaft and switches mounted on said machine, said control member adapted to contact said switches during said each cycle of rotation of said arms.

* * * * *